United States Patent [19]

Scholz

[11] Patent Number: 5,064,978

[45] Date of Patent: Nov. 12, 1991

[54] ASSEMBLY WITH SELF-REGULATING TEMPERATURE HEATER PERFORM FOR TERMINATING CONDUCTORS AND INSULATING THE TERMINATION

[75] Inventor: James P. Scholz, New Cumberland, Pa.

[73] Assignee: AMP Incorporated, Harrisburg, Pa.

[21] Appl. No.: 375,787

[22] Filed: Jun. 30, 1989

[51] Int. Cl.[5] ..... H05B 6/10

[52] U.S. Cl. ..... 219/9.5; 219/10.75; 219/85.11; 29/857

[58] Field of Search ..... 219/9.5, 85.11, 10.75, 219/10.57; 29/860, 857, 447; 174/84 R, DIG. 8

[56] References Cited

U.S. PATENT DOCUMENTS

| | | | |
|---|---|---|---|
| 2,759,161 | 8/1956 | Berg | 339/97 |
| 3,396,460 | 8/1968 | Wetmore | 29/629 |
| 3,525,799 | 8/1970 | Ellis et al. | 174/84 |
| 3,601,783 | 8/1971 | Loose | 339/223 R |
| 3,721,749 | 3/1973 | Clabburn | 174/88 R |
| 3,930,606 | 1/1976 | Dewdney | 228/232 |
| 3,945,114 | 3/1976 | Siden et al. | 29/628 |
| 4,251,305 | 2/1981 | Becker et al. | 156/86 |
| 4,256,945 | 3/1981 | Carter et al. | 219/10.75 |
| 4,341,921 | 7/1982 | Simpson | 174/84 R |
| 4,464,540 | 8/1984 | Reeder | 174/35 C |
| 4,504,699 | 3/1985 | Dones et al. | 174/84 R |
| 4,595,724 | 6/1986 | Koblitz | 524/409 |
| 4,623,401 | 11/1986 | Derbyshire et al. | 148/13 |
| 4,626,767 | 12/1986 | Clappier et al. | 323/280 |
| 4,659,912 | 4/1987 | Derbyshire | 219/535 |
| 4,695,713 | 9/1987 | Krumme | 219/553 |
| 4,696,841 | 9/1987 | Vidakovits | 428/36 |
| 4,701,587 | 10/1987 | Carter et al. | 219/10.75 |
| 4,717,814 | 1/1988 | Krumme | 219/553 |
| 4,722,471 | 2/1988 | Gray et al. | 228/265 |
| 4,745,264 | 5/1988 | Carter | 219/553 |
| 4,752,673 | 6/1988 | Krumme | 219/553 |
| 4,771,151 | 9/1988 | Pursell | 219/9.5 |
| 4,795,870 | 1/1989 | Krumme et al. | 219/9.5 |
| 4,852,252 | 8/1989 | Ayer | 29/860 |

FOREIGN PATENT DOCUMENTS

| | | |
|---|---|---|
| 0241597 | 10/1987 | European Pat. Off. . |
| 84/02098 | 6/1984 | PCT Int'l Appl. . |

*Primary Examiner*—Philip H. Leung
*Attorney, Agent, or Firm*—Anton P. Ness

[57] ABSTRACT

A heater preform comprised of a layer of magnetic material on a layer of nonmagnetic conductive metal comprises a self-regulating heater, and the heater preform is wrapped around or against a solder preform within a length of heat recoverable tubing. A conductor wire is inserted into one end of the tubing and a terminal solder tail into the other end; when radio frequency current is induced in the heater preform by a surrounding coil, the heater generates thermal energy melting the solder within the tubing, terminating the terminal to the wire, or two wires together. With sealant preforms at the ends of the tubing, the sealant preforms melt and the tubing shrinks to conform to the wire and terminal therewithin, sealing the termination simultaneously with forming the solder joint.

4 Claims, 6 Drawing Sheets

ASSEMBLY WITH SELF-REGULATING TEMPERATURE HEATER PERFORM FOR TERMINATING CONDUCTORS AND INSULATING THE TERMINATION

FIELD OF THE INVENTION

The present invention relates to the field of electrical connectors and more particularly to multiterminal connectors for terminating a plurality of conductor wires.

BACKGROUND OF THE INVENTION

Electrical connectors are known which have a plurality of terminals disposed in a dielectric housing and which are to be terminated to a respective plurality of conductor wires In one such connector the terminals are disposed in a single row within a housing molded thereover and extend rearwardly from the housing, to conclude in termination sections comprising shallow channels termed solder tails The housing may include cylindrical portions extending rearwardly to surround the terminals forwardly of the solder tails. When the conductor wires are prepared to be terminated to the solder tails, individual sleeve-like solder preforms encased within respective longer sleeves of heat recoverable or heat shrink tubing are placed over the rearwardly extending terminal portions so that the solder preforms surround the solder tails, or a strip of such units appropriately spaced apart; the stripped wire ends are then inserted into the heat recoverable tubing sleeves and into the solder preforms surrounding the solder tails; the entire assembly is then placed in a conventional thermal energy source and heated by convection, with the heat energy penetrating through the heat recoverable tubing to melt the solder which then flows around the stripped wire ends within the solder tails and upon cooling forms respective solder joints joining the conductor wires to the terminals; and simultaneously the heat recoverable tubing is heated above a threshold temperature at which the tubing shrinks in diameter until it lies adjacent and tightly against surfaces of the solder tails and the wire termination therewithin, a portion of the insulated conductor wire extending rearwardly therefrom, and a portion of the terminal extending forwardly therefrom to the rearward housing surface, sealing the exposed metal surfaces Apparatus for wire and sleeve handling with respect to such a connector is known such as from U S. Pat. No. 3,945,114. Within forward and rearward ends of the tubing are located short sleeve-like preforms of fusible sealant material which will shrink and also tackify upon heating to bond and seal to the insulation of the wire, and to the cylindrical housing portions therewithin and to bond to the surrounding heat recoverable tubing Examples of such assemblies of heat recoverable tubing lengths with solder preforms and sealant preforms therein are disclosed in U.S. Pat. Nos. 3,525,799; 4,341,921 and 4,595,724.

Conventional thermal energy sources achieve a temperature in excess of a control temperature, which is chosen to be somewhat above the ideal temperature at which a particular solder material melts in order to compensate for less than ideal thermal energy transfer. Several disadvantages attend such a thermal energy delivery method: portions of the connector other than connection sites are subjected to substantial heat which may be detrimental to the connector material; the thermal energy applied to connector portions other than the connection sites is wasted; components possibly may be damaged because of general overheating, and some sites may achieve a temperature much higher than necessary in order to assure that other sites achieve a sufficient solder melting temperature; the thermal energy source either requires a long warm-up period which is wasteful of time, or remains heated at its steady state temperature which is wasteful of energy; and maintenance of a continuous and accurate control over temperature and time is an ideal desire requiring a diligence and responsive apparatus not consistently met or found in practice. Another disadvantage is that heat recoverable tubing which is initially made transparent and is desired to remain transparent to allow visual inspection of the solder joint after termination, commonly receives enough excess thermal energy to opaquify, at least obscuring the solder joint therewithin.

It is known in the prior art to utilize a self-regulating temperature source which when energized by a constant amplitude, high frequency alternating current passing therethrough, generates thermal energy and achieves a resulting constant temperature. Such a temperature can be selected to be just higher than the ideal temperature at which solder melts. The self-regulating temperature source is disclosed in U.S. Pat. Nos. 4,256,945; 4,623,401; 4,659,912; 4,695,713; 4,701,587; 4,717,814; 4,745,264 and European Patent Publication No. 0241,597, which are expressly incorporated herein by reference. The self-regulating temperature source employs a substrate of copper or copper alloy or other conductive material of low electrical resistivity, negligible magnetic permeability and high thermal conductivity; deposited on one surface thereof is a thin layer of thermally conductive magnetic material such as iron, nickel or a nickel-iron alloy having a much higher electrical resistance and magnetic permeability than the substrate material.

When a radio frequency current for example is passed through such a two-layer structure, the current initially is concentrated in the thin high resistance magnetic material layer which causes heating; when the temperature in the magnetic material layer reaches its Curie temperature, it is known that the magnetic permeability of the layer decreases dramatically; the current density profile then expands into the non-magnetic substrate of low resistivity. The thermal energy is then transmitted by conduction to adjacent structure such as wires and solder which act as thermal sinks; since the temperature at thermal sink locations does not rise to the magnetic material's Curie temperature as quickly as at non-sink locations, the current remains concentrated in those portions of the magnetic material layer adjacent the thermal sink locations and is distributed in the low resistance substrate at non-sink locations It is known that for a given frequency the self-regulating temperature source achieves and maintains a certain maximum temperature dependent on the particular magnetic material.

The conductive substrate can be copper having a magnetic permeability of about one and a resistivity of about 1.72 micro-ohms per centimeter The magnetic material may be for example a clad coating of nickel-iron alloy such as Alloy No. 42 (forty-two percent nickel, fifty-eight percent iron) or Alloy No. 42-6 (forty-two percent nickel, fifty-two percent iron, six percent chromium). Typical magnetic permeabilities for the magnetic layer range from fifty to about one thousand, and electrical resistivities normally range from twenty to ninety micro-ohms per centimeter as compared to 1.72 for copper; the magnetic material layer can have a Curie temperature selected to be from the range of between 200° C. to 500° C. The thickness of the magnetic material layer is typically one skin depth; the skin depth is proportional to the square root of the resistivity of the magnetic material, and is inversely proportional to the square root of the product of the magnetic permeability of the magnetic material and the frequency of the alternating current passing through the two-layer structure U.S. Pat. No. 4,987,283 discloses a method for terminating and sealing a termination of electrical conductors employing self-regulating temperature source technology, whether the conductors be a conductor wire and a termination section of a terminal or a pair of conductor wires. A stripped wire end is placed along a solder tail of a terminal; a sleeve-like solder preform containing flux is disposed around the wire end and solder tail; the solder preform is contained within a length of heat recoverable tubing which extends axially to opposed tubing ends around the insulated wire portion and an insulated terminal portion; sealant preforms are disposed within the opposed tubing ends and around the insulated wire portion and insulated terminal portion; a heater means having a first layer of conductive nonmagnetic metal and a second layer of high resistance magnetic material is placed around the heat recoverable tubing length; a high frequency alternating current is induced in or transmitted to the heater means which then generates thermal energy; and the thermal energy is transmitted to the tubing and the solder and sealant preforms, melting the solder to terminate the wire to the terminal and melting and tackifying the sealant preforms to bond to the insulated wire and terminal portions and shrinking the tubing, thus forming a termination and sealing it simultaneously.

In one exemplary embodiment of Ser. No. U.S. Pat. No. 4,987,283 a terminal subassembly is formed by placing a plurality of terminals in a dielectric housing, such as by molding dielectric material around body sections of the terminals, and contact sections of the terminals are exposed along a mating face of the housing for eventual mating with corresponding contact sections of another connector. Termination sections of the terminals extend rearwardly from the housing to be terminated to individual conductor wires, and comprise preferably shallow channels. Sleeve-like preforms of solder with flux are disposed around the termination sections, with lengths of heat recoverably tubing around the solder preforms and extending forwardly over cylindrical housing flanges covering the terminals forwardly of the terminating sections, to the rear surface of the housing, and rearwardly a distance beyond the ends of the termination sections. End portions of the insulated wires extend into the rearward end of the heat recoverable tubing lengths so that the stripped ends of conductor wires are placed along the respective channels of the termination sections of the terminals and within the solder preforms. Sleeve-like preforms of sealant material are disposed within the forward and rearward tubing sections to melt and shrink, tackify and bond to the housing flanges and wire insulation respectively, and bond to the surrounding portions of heat recoverable tubing.

Then, in accordance with Ser. No. U.S. Pat. No. 4,987,283 a heater means is then placed in position across the termination region above and below the termination sections. The heater means may be a strap wrapped around the plurality of termination sections having the heat recoverable tubing sleeves thereover containing the solder preforms. The metal strap comprises a self-regulating temperature source and includes two layers of different metals: a first layer of electrically conductive, low resistivity, low magnetic permeability metal such as copper or copper alloy; and a second layer of metal having high resistivity and high magnetic permeability such as iron, nickel or nickel-iron alloy. A selected constant amplitude high frequency alternating current is generated by an appropriate apparatus which is transmitted to or induced in the strap. The current in the strap over a short length of time produces thermal energy which rises to a certain temperature selected to be slightly higher than needed to melt the solder preforms The thermal energy is transmitted to the solder preforms within the lengths of heat recoverable tubing around the respective termination sections thereby melting the solder which forms solder joints between the wires and the termination sections. The thermal energy also is transmitted to and begins to melt and shrink and tackify the sealant preforms and to shrink the surrounding heat recoverable tubing which reduces to conform to the outer surfaces of the structure therewithin including the insulated wire portion, the termination sections including the terminations, the shrunken sealant preforms and the housing flanges The terminations of the terminals to the wires are completed and the terminations and all exposed metal is sealed and the strap removed, completing the connector. The current may be induced in the strap by an appropriate apparatus having a coil surrounding the strap which is disposed around the termination region transverse to the assembly, and the coil then being energized.

There is disclosed in U.S. Pat. No. 4,852,252 the use of terminal solder tails which have a layer of magnetic material clad onto an outer surface. When a stripped wire end is disposed along the inner surface of the solder tail and heat recoverable tubing assembly is placed thereover, and radio frequency current is induced in the solder tail by reason of the magnetic material, the heat melts the solder preform within the tubing to solder the wire end to the solder tail; simultaneously the sealant preforms are melted and seal the termination.

It is desired to obtain solder joints without heating all portions of the connector.

It is desired to consistently obtain assured solder joints in a multiterminal connector having prehoused terminals.

It is desired to provide a simple and convenient method for soldering and sealing a termination.

It is desired to provide a simple and convenient method for soldering and sealing a termination of a stripped wire end to a solder tail of a conventional terminal.

SUMMARY OF THE INVENTION

The present invention employs self-regulating temperature source technology to terminate a conductor wire to a termination section of a terminal, or to splice together a pair of conductor wires. A heater preform is disposed within a length of heat recoverable tubing which also has disposed therein a solder preform, preferably such that the heater preform is adjacent and against the solder preform for substantial thermally conductive engagement. Disposed at each end of the tubing is a sealant preform. When radio frequency current is induced in the heater preform such as by placing a coil around the outside of the tubing or around a plurality of such tubings for a plurality of such terminations, heat is generated and transmitted to the solder to melt the solder to join the wire end to the solder tail, and to melt the sealant material and shrink the heat recoverable tubing. The heater preform is constructed to be reduceable in diameter by being compressed radially inwardly by the shrinking tubing to permit the tubing to reduce in diameter upon being heated to its recovery temperature.

It is an objective to provide a method for joining a pair of conductive means to each other and simultaneously sealing the joint thus formed.

It is an objective to provide a connector having a plurality of discrete terminals to be terminated to conductor wires and then sealed in a simple, assured, efficient and economical process It is another objective to solder the wires and seal the terminations simultaneously.

It is a further objective to solder the wires to the terminals by assuredly achieving a certain selected temperature at all termination sites.

It is yet another objective to provide the necessary elevated temperature within only the region containing the termination sites.

It is still another objective to provide a self-regulating temperature source which minimizes the amount of excess heat received by the tubing, enhancing its ability to remain transparent, and thereby allow visual inspection of the solder joint.

It is an additional objective of the present invention to provide a simple and convenient method of simultaneous soldering and sealing by providing the lengths of heat recoverable tubing with individual thermal energy sources, eliminating the necessity of providing and manipulating a separate self-regulating temperature source.

It is yet another objective to provide the thermal energy from a source within the solder sleeve, with the energy then radiating outwardly to sealant preforms and transparent tubing therearound after the solder melts, thus minimizing the amount of excess heat received by the tubing, enhancing its ability to remain transparent, and thereby allow visible inspection of the solder joint.

Examples of the present invention will now be described with reference to the accompanying drawings.

BRIEF DESCRIPTION OF THE DRAWINGS

FIGS. 8 and 9 are perspective views of additional embodiments of heater preforms of the present invention, shown with solder preforms; and FIG. 10 is a longitudinal section view of an alternate embodiment showing splicing of ends of a pair of wires using the present invention.

DETAILED DESCRIPTION OF THE PREFERRED EMBODIMENTS

Figure 1:
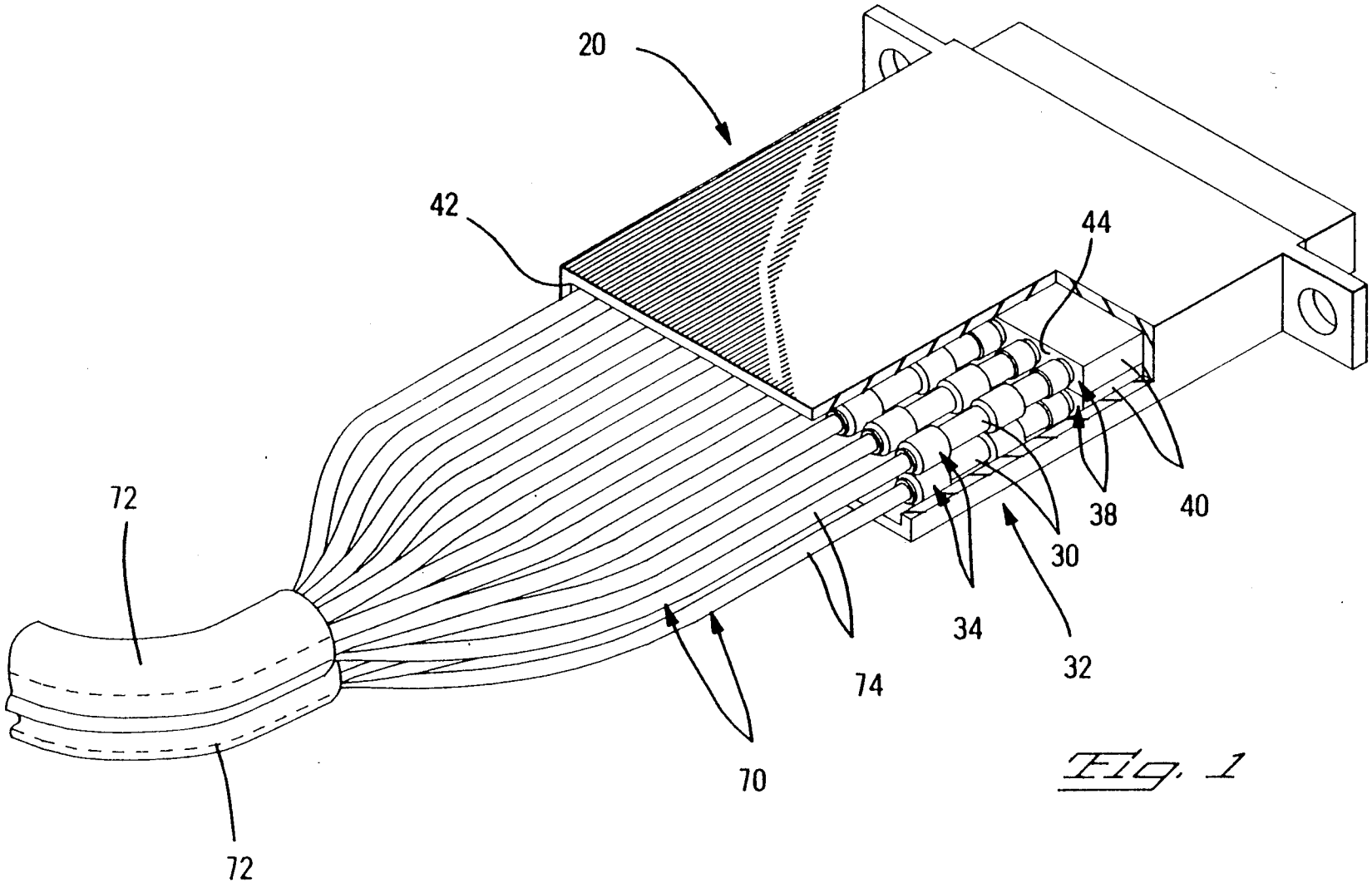
FIG. 1 is a perspective view of a connector with which the present invention is used.

FIG. 1 shows a connector 20 having a plurality of terminals 10 (FIG. 2) secured within a pair of dielectric housings 40 within a shell 42. Terminals 10 are terminated at terminations 30 to a respective plurality of conductor wires 70 within a termination region 32 rearwardly of wire face 44 of housings 40. Respective blade contact sections 12 (FIG. 2) of terminals 10 extend forwardly from a mating face of housings 40 to be mated eventually with corresponding contact sections of terminals of a mating connector (not shown). Conductor wires 70 have insulation material therearound and may be bundled within an outer jacket 72. The termination region 32 includes individual seals 34 formed around terminations 30 and extending from wire face 44 of each housing 40 to insulated end portions 74 of wires 70. The terminals 10 are shown disposed in single rows for a low profile module 38 for a miniature rectangular connector, although the present invention may be used with other styles of connectors and other terminal arrangements. Terminals may also be socket or receptacle-type terminals.

Figure 2:
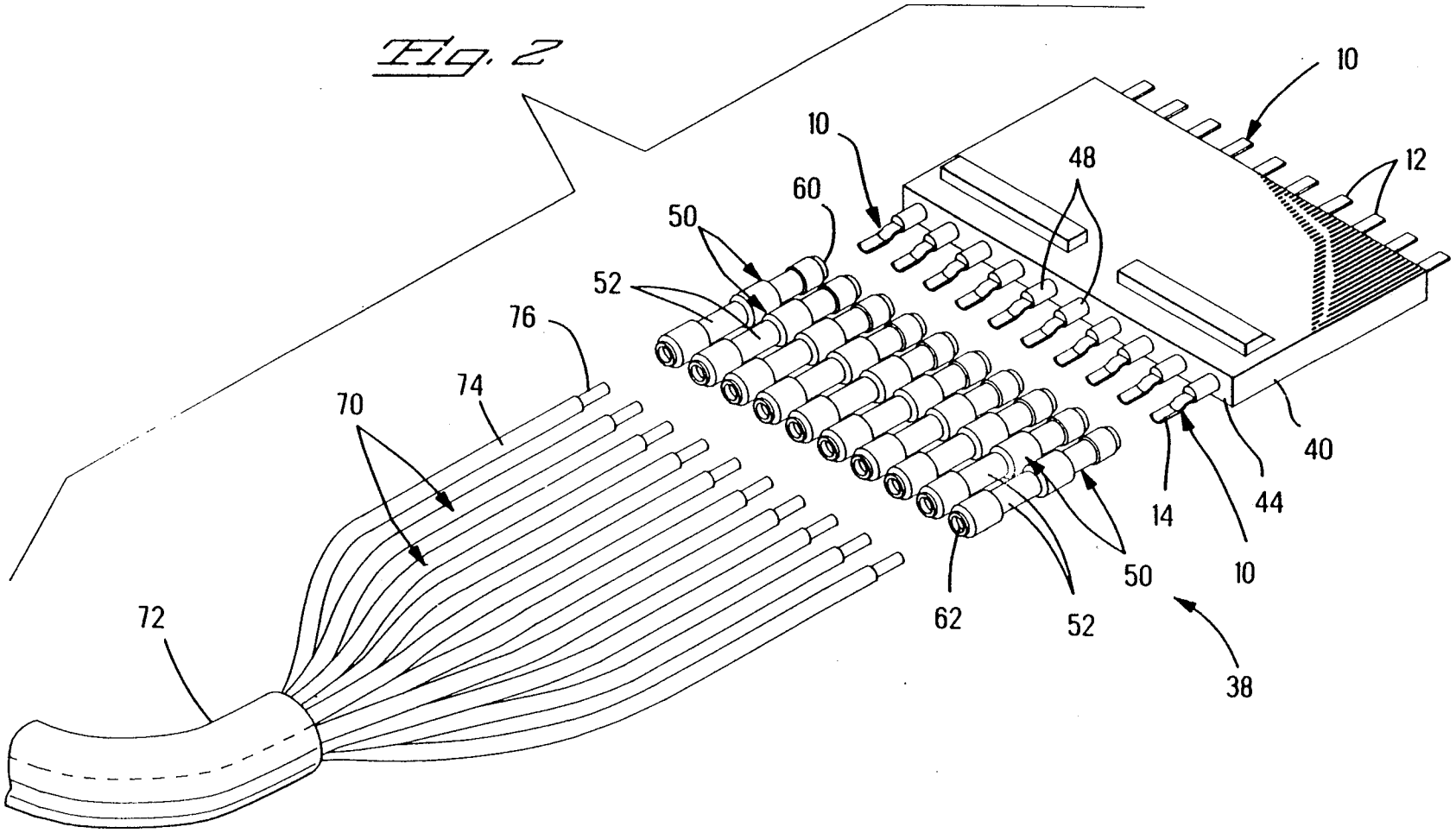
FIG. 2 is similar to FIG. 1 with a terminal subassembly of the connector exploded from the conductor wires, showing lengths of heat recoverable tubing containing solder preforms used in the assembly of the connector.

Referring to FIG. 2, each terminal 10 includes a terminating section 14 disposed at the end of an intermediate section 16 extending rearwardly from a body section secured within housing 40. Preferably much of intermediate section 16 is embedded within a cylindrical housing portion or flange 48 extending rearwardly from wire face 44 to facilitate eventual process steps and to assure appropriate sealing. Flange 48 may include annular ribs (not shown) or other projections to assist eventual sealing. Terminating section 14 may have a shallow channel shape and is conventionally termed a solder tail for eventual placement of a stripped end portion 76 of a conductor wire 70. Sleeve assembly 50 associated with solder tail 14 comprises a length of heat recoverable tubing 52, which includes centrally therewithin a solder preform and a heater preform, and preferably includes two sealant preforms also therewithin at the ends thereof.

Figures 3, 4:
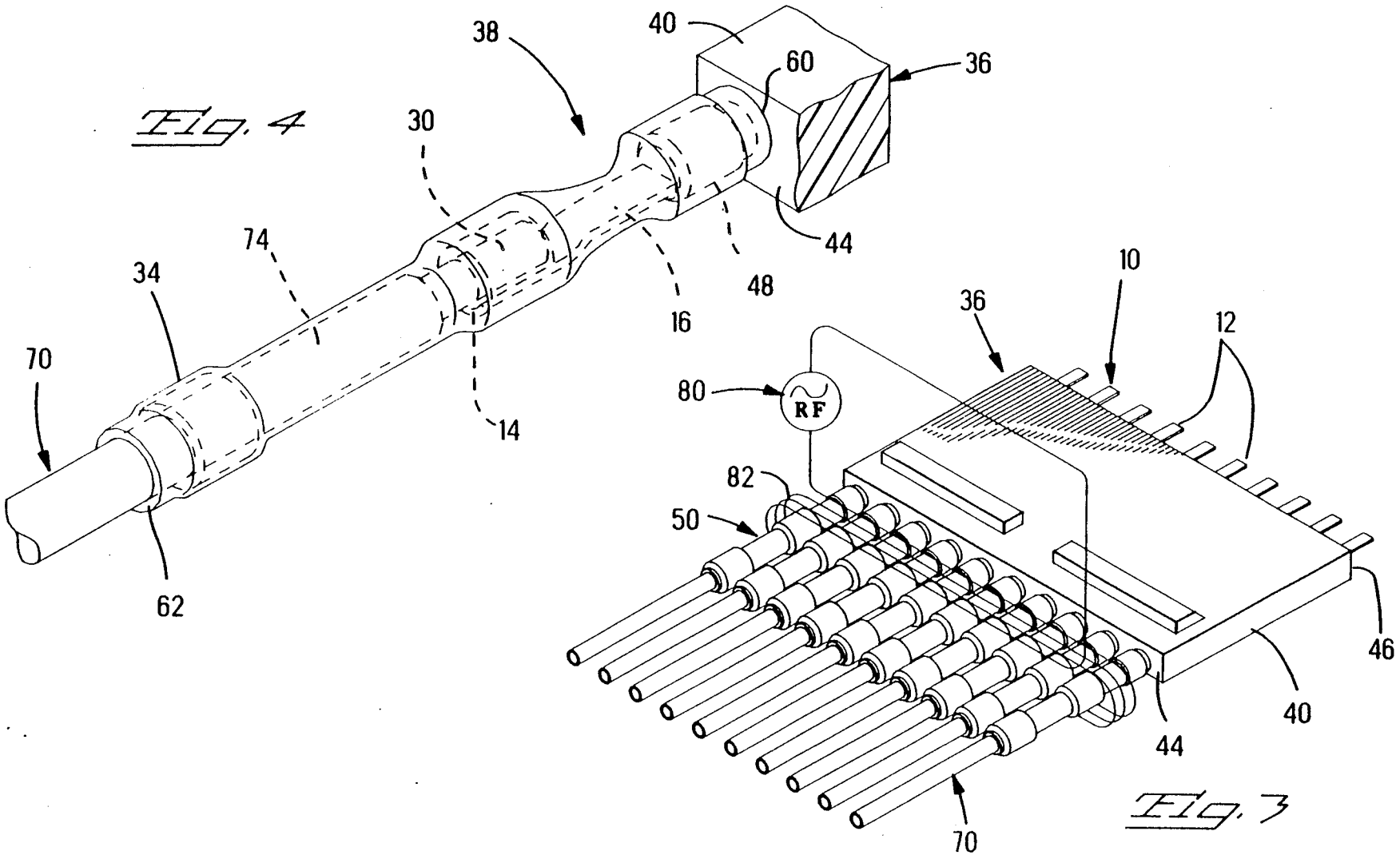
FIG. 3 is a diagrammatic view showing the terminal subassembly and wires being terminated by a high frequency current generator.
FIG. 4 illustrates a soldered and sealed termination.

FIG. 3 illustrates the method of terminating the wire ends and solder tails of housing 40 and sealing the terminations. The terminal subassembly and inserted wires have been placed and clamped within an apparatus 80 containing an inductance coil 82 closely surrounding the terminating region 32. A constant amplitude high frequency alternating current is generated by apparatus 80 such as a radio frequency signal at a frequency of 13.56 MHz such as by an apparatus disclosed in U.S. Pat. No. 4,626,767. After a length of time such as about 30 seconds, the heater preforms within the respective lengths of tubing have each achieved a certain temperature determined by the particular magnetic material of the heater preforms, which penetrates the tubing lengths and melts the solder preforms, and then shrinks the tubing lengths resulting in the sealed terminations of FIG. 4.

FIG. 4 shows a terminated and sealed connection after the solder has been melted according to the present invention with thermal energy generated by heater preform 100 to form a solder joint termination 30 between wire end 76 and solder tail 14, the sealant preform at leading end 60 has been shrunk in diameter to bond to flange 48 while the sealant preform at trailing end 62 has been shrunk in diameter to bond to insulated wire end 74, and tubing 52 has shrunk to conform to the outer surfaces of the structures therewithin, and bonds to the sealant preforms thereby sealing the termination by tightly gripping about the insulated wire end 74 at trailing end 62 and the flange 48 at leading end 60, forming a seal 34 extending between insulated conductor 70 and housing 40.

Figures 5, 6:
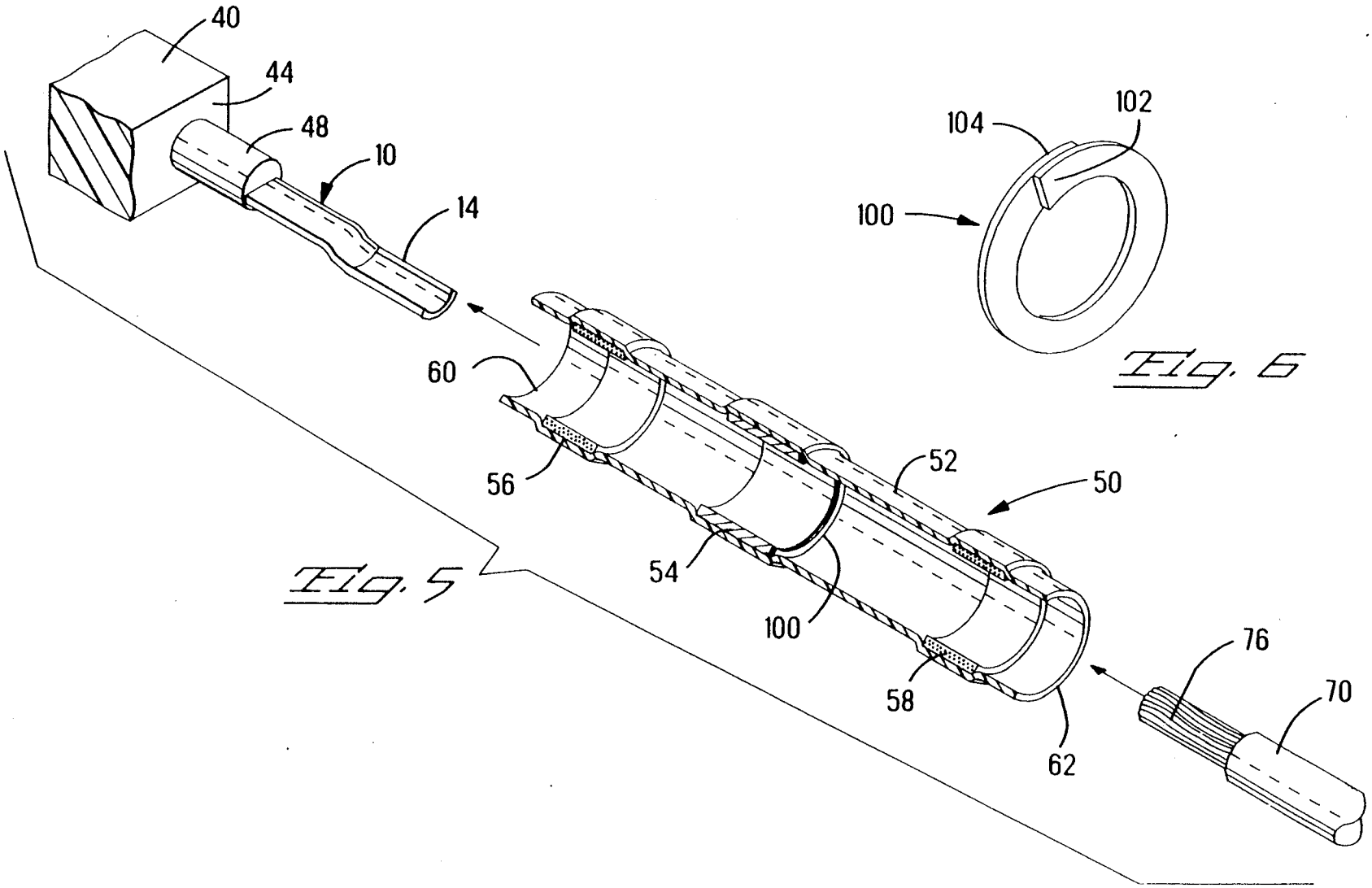
FIG. 5 is an enlarged perspective, part section view of a sleeve assembly to be placed over a solder tail and receive a wire end thereinto, with a first embodiment of heater preform therewithin.
FIG. 6 is a perspective view of the heater preform of FIG. 5.
Figures 7A, 7B, 7C, 7D:
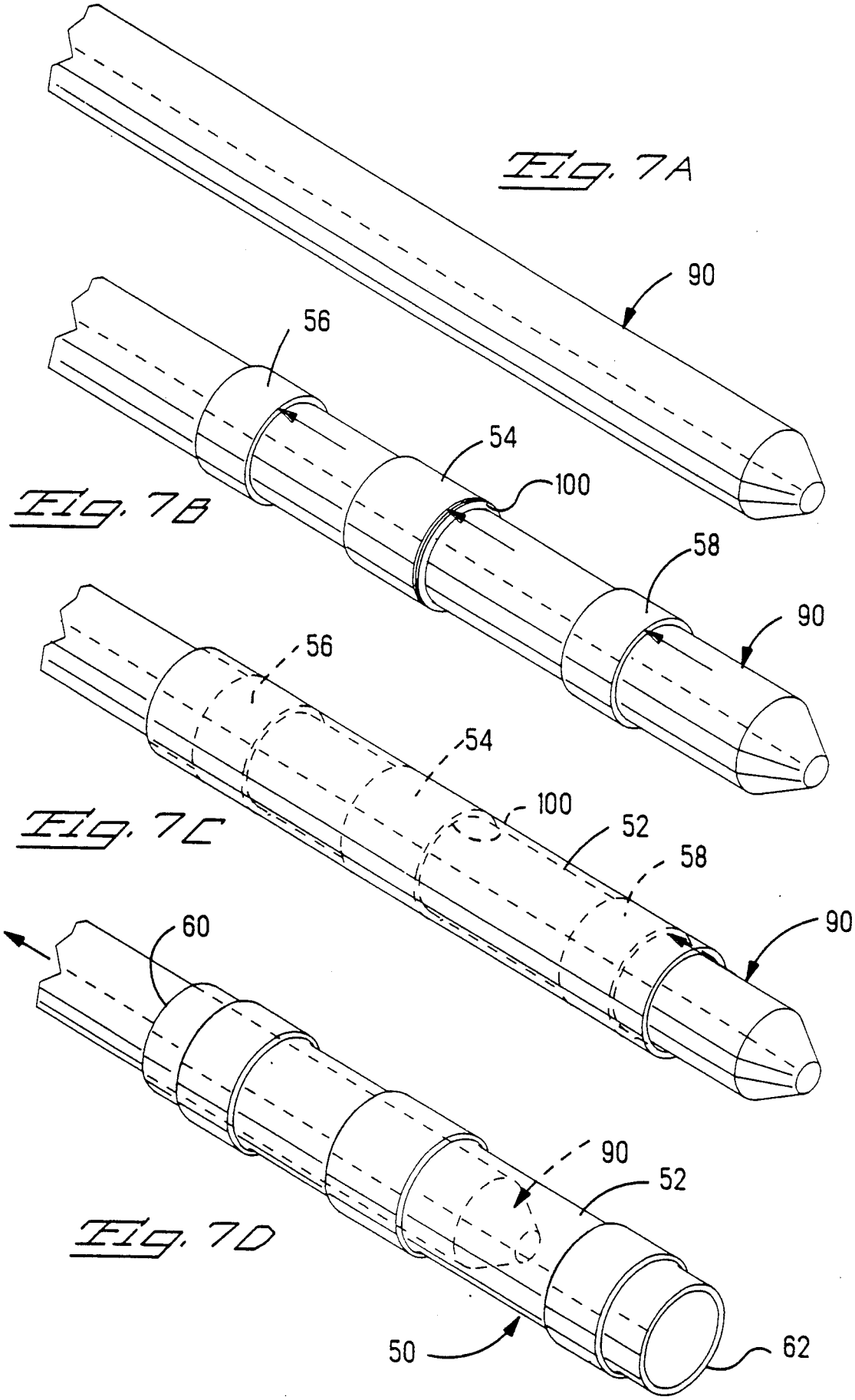
FIG. 7A to 7D are perspective views showing a representative method of assembling a heater preform of the present invention into a length of heat recoverable tubing.
Figures 7A, 7B, 7C, 7D:
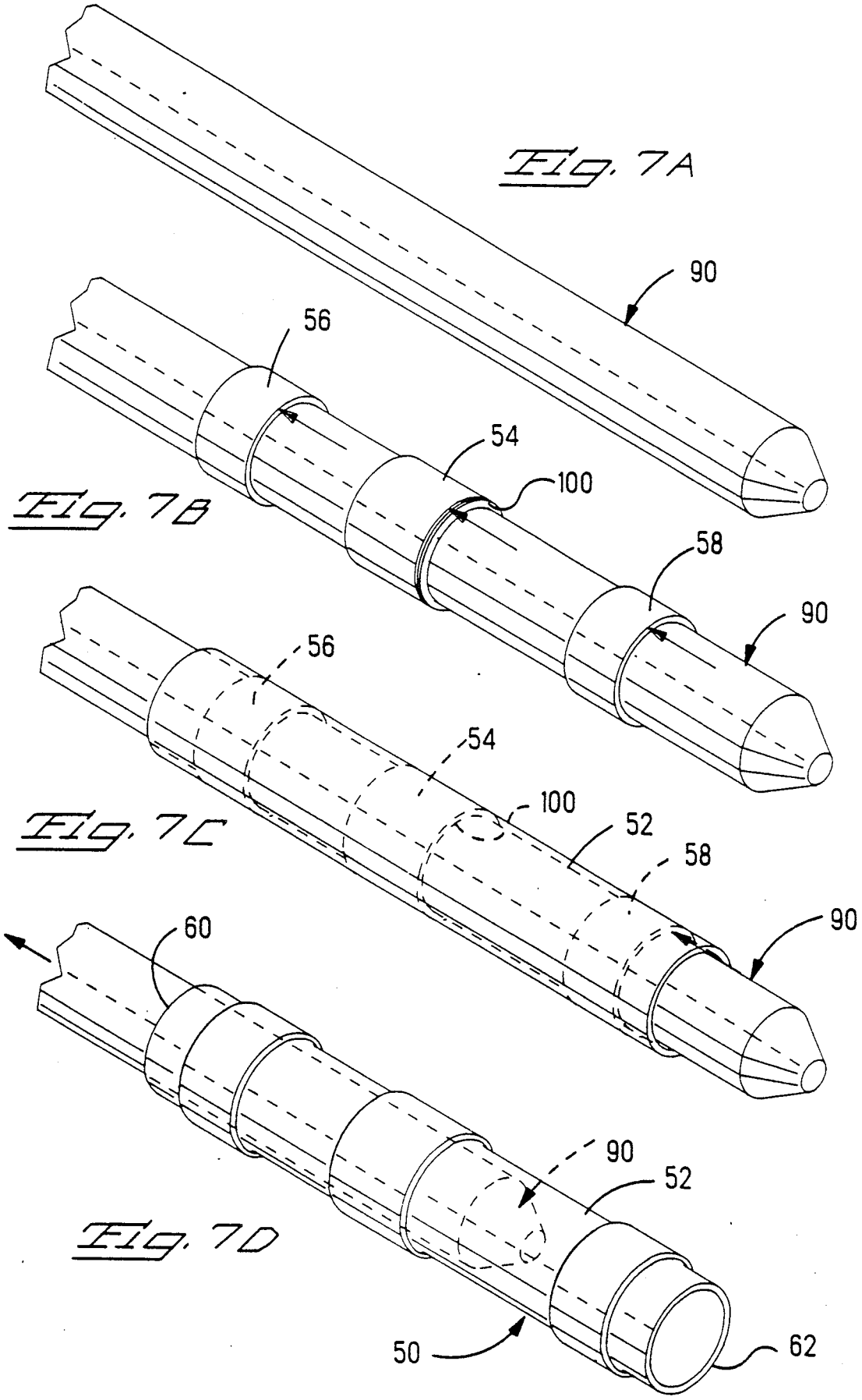

Referring now to FIGS. 5 and 6, solder preform 54 preferably is formed in a sleeve shape of short length large enough to be placed over and around a respective solder tail 14 and also then to receive a stripped conductor wire end thereinto. Length 52 of preferably transparent heat recoverable tubing is formed to be placed over solder preform 54 and be sufficiently long to extend over flange 48 from wire face 44, over solder tail 14, and over insulated wire end portion 76. Solder preform 54 is placed within tubing 52 at an axial location appropriate so that when the sleeve assemblies 50 are placed over the rearwardly extending terminal portions the solder preform 54 will surround the solder tail 14. Sealant preforms 56,58 are short sleeves axially spaced to be disposed over flange 48 and the insulated wire end portion 74 respectively. The plurality of sleeve assemblies 50 for the plurality of solder tails 14 may be joined if desired by a strip of adhesive tape or the like to form a single entity for convenient handling as is conventionally known, with sleeve assemblies 50 appropriately spaced apart to correspond to the spacing of the terminals 10 secured in housing 40.

Solder preform 54 may be made of tin-lead solder including solder flux mixed therein or coated therearound, such as for example Sn 63 meltable at a temperature of about 183° C. or Sb-5 meltable at about 240° C.; sealant preforms 56,58 may comprise for example a homogeneous mixture of polyvinylidene fluoride, methacrylate polymer and antimony oxide, which will shrink in diameter at a nominal temperature selected to be about 190° C.; and tubing 52 is preferably transparent and may be of cross-linked polyvinylidene fluoride and have a nominal shrinking temperature of about 175° C. Generally it would be preferable to provide a thermal energy source capable of achieving a temperature of about 50° C. to 75° C. above the solder melting point.

Referring to FIGS. 5 and 3, during the termination and sealing procedure leading end 60 of sleeve assembly 50 is placed over a respective solder tail 14 and moved forwardly until leading end 60 abuts wire face 44 of housing 40, so that sealant preform 56 surrounds flange 48 and solder preform 54 surrounds solder tail 14. Optionally in a preliminary assembly step a limited amount of heat may then be applied locally to leading end 60 thereby reducing sealant preform 56 to bond to flange 48 (which may have a plurality of annular ribs, not shown) to resist axially rearward pulling on the sleeve assembly 50; tubing 52 also reduces in diameter around flange 46 and sealant preform 56. Such a preliminary assembly step allows housing 40 and the plurality of sleeve assemblies 50 to be handled as a unit, housing/-sleeve assembly 36. Stripped conductor wire 76 is inserted into trailing end 62 of sleeve assembly 50 until located such as by visual observation through transparent tubing 52 completely along solder tail 14 within solder preform 54 and insulated end portion 74 is disposed within sealant preform 58.

In FIGS. 5 and 6 heater preform 100 comprises a C-shaped ring shaped like a washer and disposed substantially in a transverse plane. Since heater preforms of the present invention are to generate thermal energy to melt solder preforms 54, the heater preforms are adjacent and against a surface of the solder preforms to establish a thermally conductive engagement. Heater preform 100 is disposed against an end of solder preform 54 at least after being assembled within sleeve 52. It is preferred that heater preforms of the present invention be shaped and constructed to be easily reduceable in diameter to permit the sleeve of heat recoverable tubing 52 to reduce in diameter upon being heated to its recovery temperature. Heater preform 100 therefore is thin with ends 102,104 overlapping within sleeve 52 to facilitate being compressed by sliding past each other. When tubing 52 begins to reduce in diameter, it is thus able to compress thin heater preform 100 which no longer is supported by solder preform 54 and may have a foil-like consistency thin enough to be partially crushed by the tubing.

Solder preform 54 and sealant preforms 56,58 are secured within tubing 52 such as by being mounted on a mandrel 90, as seen in FIGS. 7A through 7D, which is believed to be in accordance with conventional practice, after which tubing 52 is partially recovered or shrunk to grip around the solder and sealant preforms, and then the assembly is removed from the mandrel. In accordance with the present invention, heater preform 100 is assembled to the mandrel 90 when the solder and sealant preforms are placed therearound, with heater preform 100 placed adjacent and against end 92 of solder preform 54 which tubing 52 is then placed thereover and then partially shrunk or reduced in diameter therearound, and the assembly 50 thus formed is removed from the mandrel.

Heater preform 200 of FIG. 8 comprises a spiral shape wrapped around solder preform 202, with ends 204,206 extending past and beside each other, so that upon shrinking of the tubing disposed therearound the spiral shape can be easily reduced in diameter as ends 204,206 continue to slide past each other. Heater preform 300 of FIG. 9 is a C-shape disposed around solder preform 302, with ends 304,306 spaced apart to permit a reduction in diameter caused by shrinking of the tubing therearound.

Heater preform 100 of FIGS. 5 and 6 and heater preforms 200 and 300 of FIGS. 8 and 9 comprise a first layer comprising a substrate of copper or copper alloy such as brass or phosphor bronze having a thickness of for example 0.002 inches. One major surface of the substrate to face away from the solder preform upon assembly, has deposited thereon a thin second layer of magnetic material such as a nickel-iron alloy like Alloy No. 42 having a thickness of for example between 0.0004 and 0.0006 inches. Typically a roll cladding process may be used where an amount of the magnetic material is laid over the substrate, then subjected to high pressure and temperature which diffuses the two materials together at the boundary layer, but other processes such as plating or sputter depositing could be used. A thin layer of dielectric coating material may be applied over the magnetic material to inhibit oxidation, and/or optionally a thin layer of solder resist may be used to coat the magnetic layer especially with heater preform 100 of FIGS. 5 and 6 to inhibit flow of the molten solder away from the termination site. Optionally a heater preform could be formed by plating a layer of nickel onto a layer of copper to a thickness preferably 1 ½ to 2 times the skin depth of nickel at the selected current frequency It is preferred that the outwardly facing surfaces of the heater preform be in engagement with the sleeve tubing therearound to transmit thermal energy to the sleeve tubing, as well as to the solder preforms adjacent or within the heater preforms. A heater preform 100,200,300 can be made to have a total thickness of about 0.0024 to 0.0028 inches thick and thus be easily shaped to be fitted to or around a solder preform either before placement of the solder preform on the mandrel, or thereafter, while having the property of being subsequently deformed by the shrinking tubing during recovery upon termination and sealing of an electrical connection of two electrical conductors.

An example of a process using the self-regulating temperature source heater preform of the present invention would be: providing an apparatus capable of providing a constant amplitude high frequency alternating current having frequency such as 13.56 MHz; selecting a solder preform having tin-lead solder with flux which melts at a nominal temperature of about 183° C.; selecting heat recoverable tubing shrinkable at a nominal temperature of 175° C.; securing against the solder preform a heater preform having a layer of brass with a thickness of 0.0020 inches and having therealong a thin clad layer of Alloy No. 42 having a thickness of between 0.0004 to 0.0006 inches; disposing the tubing around the solder and heater and sealant preforms; inserting the wire end and terminal solder tail into the tubing assembly; and applying an RF current at 13.56 MHz thereto for about 30 to 60 seconds. The self-regulating temperature source which comprises the heater preform will rise to a temperature of generally about 350° C., melt the solder, shrink the sealant preforms, and shrink the tubing Also, if solder preforms are selected having a melting temperature of about 240° C. such as Sb-5, a magnetic material may be used having a nominal Curie temperature of about 300° C. to 315° C.

FIG. 10 illustrates that a heater preform of the present invention could be used to form a sealed splice termination 400, splicing associated first and second conductors 402,404 of an array together. Stripped wire ends 406,408 of pairs of conductors to be spliced are placed within respective sleeve assemblies 410 comprised of solder preforms 412 and associated heater preforms 414 within lengths 416 of heat recoverable tubing positioned to surround the termination region 418; and generating high frequency current in the heater perform 414 by apparatus 80. The process produces thermal energy which melts the solder, permeates the heat recoverable tubing lengths and shrinks the tubing, thus splicing the conductors and sealing the splice terminations thus formed.

The construction of the heater preform may vary as is shown in FIGS. 5 through 9 in general physical shape, and can be varied in its laminar structure and be useful in carrying out the method of the present invention. Other variations may be made by skilled artisans to the present invention which are within the spirit of the invention and the scope of the claims.

What is claimed is:

1. An article for use in terminating together first and second axially alignable electrical conductors and covering the termination with dielectric material, utilizing an assembly of a length of heat recoverable dielectric tubing having a solder preform centrally disposed therewithin, the electrical conductors being insertable into the respective tubing ends, characterized in that:

a discrete heater preform member is disposed within said length of heat recoverable tubing and at least proximate said solder preform sufficient to transmit heat to said solder preform, said discrete heater preform member including a first layer of a first metal having low electrical resistance and having minimal magnetic permeability and deposited on a major surface thereof a second layer of a second metal having high electrical resistance and high magnetic permeability, said second layer having a thickness approximately equal to one skin depth of said second metal corresponding to a frequency of a source for generating a constant amplitude high frequency alternating current of known frequency.

2. An article as set forth in claim 1 further characterized in that said discrete heater preform member comprises an annulus disposed against an end edge of said solder preform.

3. An article as set forth in claim 1 further characterized in that said discrete heater preform member comprises a C-shaped sleeve surrounding and against said solder preform.

4. An article as set forth in claim 1 further characterized in that said discrete heater preform member comprises a spiral shaped sleeve surrounding and against said solder preform.

* * * * *

UNITED STATES PATENT AND TRADEMARK OFFICE

CERTIFICATE OF CORRECTION

PATENT NO. : 5,064,978

DATED : November 12, 1991

INVENTOR(S) : James P. Scholz

It is certified that error appears in the above-identified patent and that said Letters Patent is hereby corrected as shown below:

Title page, item [54], and col. 1, line 2, delete "PERFORM" and insert --PREFORM--.

Signed and Sealed this

Twentieth Day of April, 1993

*Attest:*

MICHAEL K. KIRK

*Attesting Officer*

*Acting Commissioner of Patents and Trademarks*